US005887496A

United States Patent [19]

Pollard et al.

[11] Patent Number: 5,887,496

[45] Date of Patent: Mar. 30, 1999

[54] WRENCH FOR USE ON GOLF SHOES

[76] Inventors: Owen Craig Pollard, 2370 Brookhaven Pass, Vista, Calif. 92083; Mark J. Ziminsky, 3632 Via Alicia, Oceanside, Calif. 92056

[21] Appl. No.: 870,637

[22] Filed: Jun. 6, 1997

[51] Int. Cl.[6] ..... B25B 13/48

[52] U.S. Cl. ..... 81/461; 81/176.2; 81/176.15

[58] Field of Search ..... 36/59 R, 127, 36/134; 81/489, 490, 491, 492, 461, 121.1, 124.6, 176.15, 176.2

[56] References Cited

U.S. PATENT DOCUMENTS

| | | | |
|---|---|---|---|
| 2,300,866 | 11/1942 | Bernstein | 81/176.15 |
| 2,448,805 | 9/1948 | Ingram | 81/176.15 |
| 2,459,610 | 5/1949 | Zadina | 81/176.15 |
| 3,243,831 | 4/1966 | Wigley | 81/176.15 |
| 4,356,852 | 11/1982 | Smith | 81/121.1 |
| 5,272,943 | 12/1993 | Edwards | 81/461 |
| 5,400,680 | 3/1995 | Spangler | 81/176.15 |

*Primary Examiner*—David A. Scherbel
*Assistant Examiner*—Shantese McDonald
*Attorney, Agent, or Firm*—Leonard Tachner

[57] ABSTRACT

A wrench for soft spike assemblies. The wrench provides a wrench head and a ribbed handle. The wrench head includes a plurality of symmetrically-spaced torque members and insert grip members, the former designed to frictionally engage the individual spikes and the latter designed to engage and grasp the perimeter of the spike assembly thereby facilitating hands-free installation and removal of the spike assemblies. The handle is provided with a hexagonal insert passage fore receiving an Allen-type wrench which may be used to provide increased torque in installing or removing a soft spike assembly.

6 Claims, 3 Drawing Sheets

WRENCH FOR USE ON GOLF SHOES

BACKGROUND OF THE INVENTION

1. Field of the Invention

The present invention relates generally to accessories for sports activities such as the game of golf and more particularly to a wrench for use on golf shoes for installing and removing soft spike assemblies.

2. Prior Art

Spiked shoes are well known for providing a high degree of traction which is especially useful in certain sports. Golf shoes are normally spiked to provide a golfer with extra traction which is especially important during the golf swing when slipping feet can otherwise cause poor performance. In the past, the spikes in golf shoes have been made of metal having a unitary truncated conical shape about one-quarter inch long. Each such spike usually has a threaded insert which is received in a receptacle in the shoe sole exterior surface, the receptacle having a mating thread. A typical golf shoe has ten to twelve such spikes and the distribution of the spikes is designed to provide firm traction as the golfer shifts his or her weight during the golf club swing. Normally, spikes wear out before the shoes wear out. The spikes are configured with a circular flange which may be made of a hard plastic. The flange will usually have at least two symmetrically spaced holes designed to receive a wrench which may be used to apply a torque to the spike and unthread the insert from the receptacle. A wrench can, of course, be used to replace a worn spike with a new spike so that a pair of golf shoes can be respiked one or more times.

Recently, many golf courses have begun to require golfers to wear soft spike golf shoes. The concern with conventional spiked shoes is that their long metal spikes damage delicate golf course surfaces, particularly the greens which must be kept as smooth as possible to facilitate proper play. In response to this relatively recent requirement, golf shoe manufacturers have begun offering shoes having a radically different type of spike assembly. This new spike assembly uses shorter, blunter spikes and compensates for reduced traction per spike by replacing each individual conventional spike with a plurality of the new spikes. This increase in the number of ground contact points, also distributes the golfer's weight over a larger number of spikes, reducing the penetration of each spike. The overall effect is retained good traction, but with less damage to delicate greens and other golf course surfaces.

SUMMARY OF THE INVENTION

The present invention comprises a wrench for soft spike assemblies. The wrench provides a wrench head and a ribbed handle. The wrench head includes a plurality of symmetrically-spaced torque members and insert grip members, the former designed to frictionally engage the individual spikes and the latter designed to engage and grasp the perimeter of the spike assembly thereby facilitating hands-free installation and removal of the spike assemblies. The handle is provided with a hexagonal insert passage for receiving an Allen-type wrench which may be used to provide increased torque in installing or removing a soft spike assembly.

OBJECTS OF THE INVENTION

It is therefore a principal object of the invention to provide a tool especially configured to facilitate installation and removal of soft spike assemblies on sports shoes such as golf shoes.

It is another object of the invention to provide a wrench for removing and installing golf shoe soft spike assemblies and which is designed to retain the assembly while the assembly is separated from the golf shoe thereby making removal and installation a substantially hands-free operation.

It is still another object of the invention to provide a golf shoe spike wrench which distributes torque over a large surface area for easier installation and removal with little or no distortion of the spike assembly.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
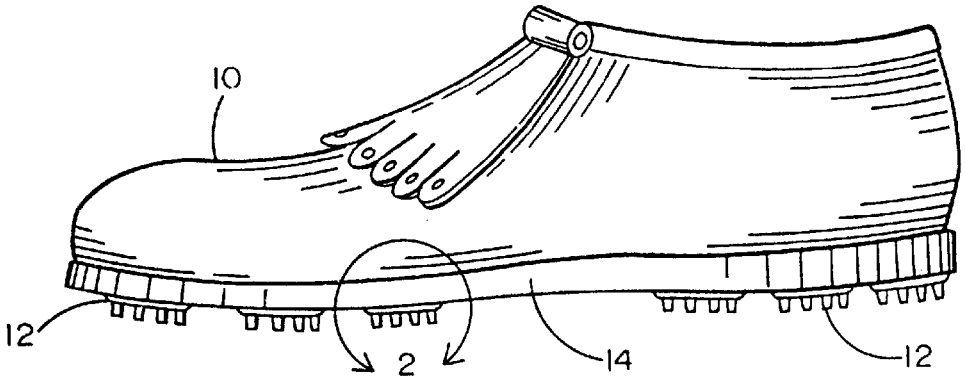
FIG. 1 (PRIOR ART)
FIG. 1 is an elevational view of a golf shoe having soft spike assemblies.
Figure 2:
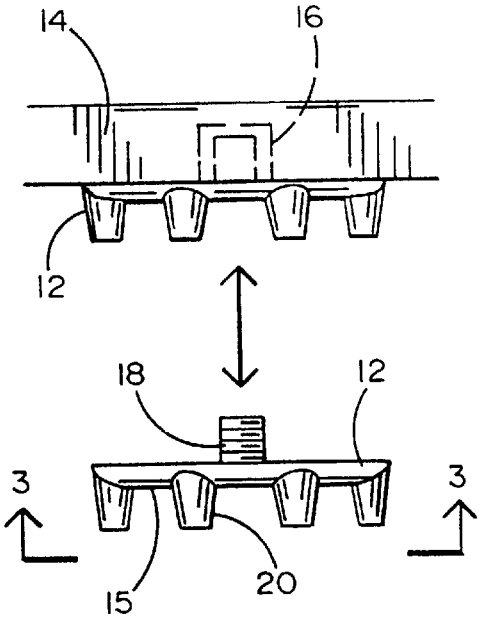
FIG. 2 (PRIOR ART)
FIG. 2 is an exploded view of a soft spike assembly and mating receptacle.
Figure 3:
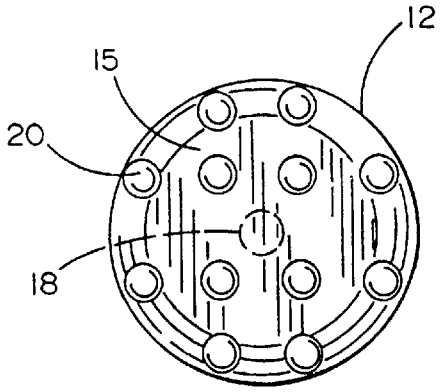
FIG. 3 (PRIOR ART)
FIG. 3 is an elevational view of a soft spike assembly.
Figure 4:
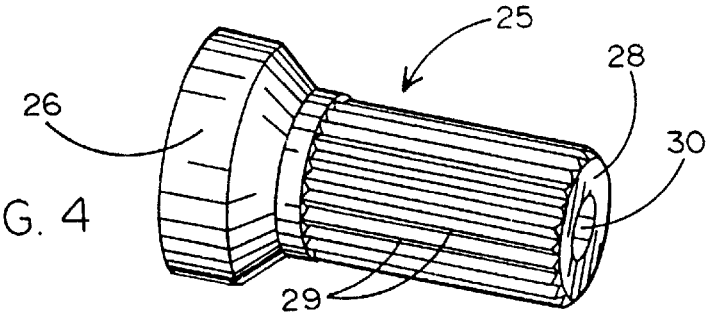
FIG. 4 is a three-dimensional view of a preferred embodiment of a spike wrench of the invention.
Figure 5:
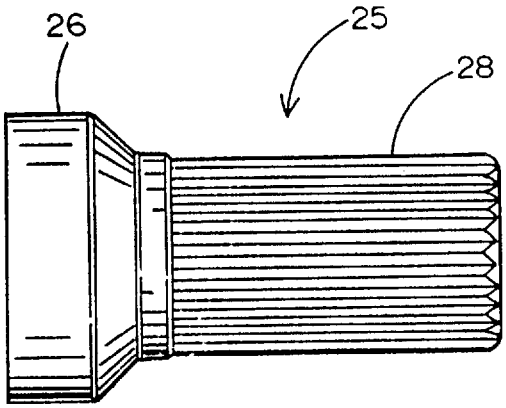
FIG. 5 is a side view of the invention.
Figure 6:
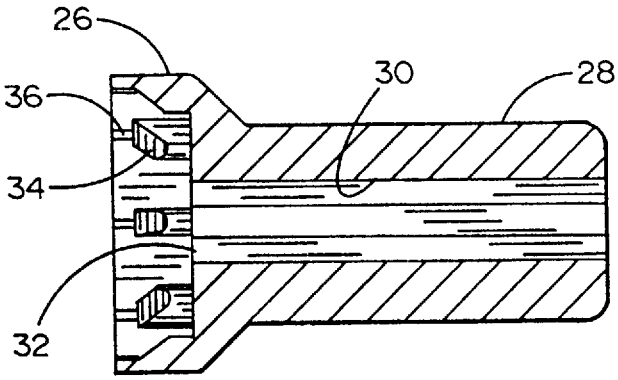
FIG. 6 is a cross-sectional view of the invention.
Figure 7:
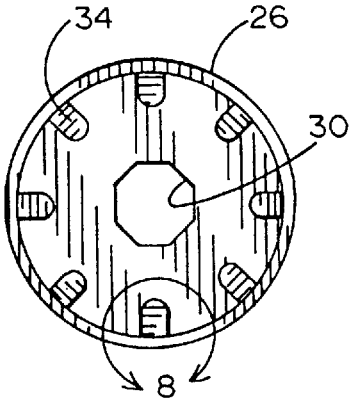
FIG. 7 is a head end view of the invention.
Figure 8:
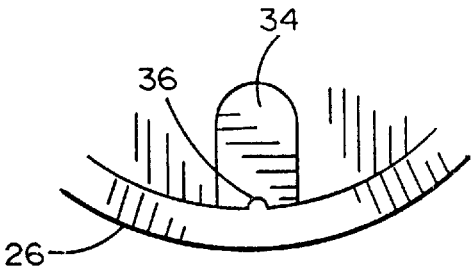
FIG. 8 is an enlarged view of torque and grip members.
Figure 9:
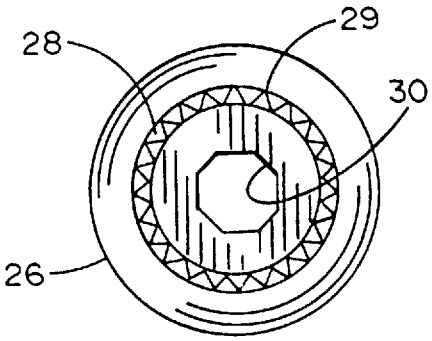
FIG. 9 is a handle end view of the invention.

Referring to the accompanying figures and initially to prior art FIGS. 1–3 in particular, it will be seen that a typical spiked shoe 10 has a plurality of soft spike assemblies 12 each installed in the bottom surface of shoe sole 14. As seen best in FIGS. 2 and 3, assembly 12 is received in a threaded recess 16 in sole 14 by means of a threaded pin 18. The pin 18 extends from the center of one surface of a flat circular disc 15 while a plurality of spikes 20 extend in the opposite direction from the pin 18 on the opposed surface of disc 15. The pins 20 are typically spaced in a symmetrical fashion as shown in FIG. 3. The "soft" characteristic of the spikes 20 is derived from their relative shorter length, their broader end surface, their greater number and from their softer material (i.e., plastic) than more conventional metal spikes.

The wrench 25 of the present invention is shown in FIGS. 4–9 to which reference is now made. As seen in those figures, the wrench comprises a wrench head 26 and an integral handle 28. Wrench head 26 is substantially bell-shaped and has a circular recess 32 wherein are positioned a plurality of torque members 34 and a like plurality of spike disc grip members 36. Circular recess 32 is dimensioned to receive the disc 15 of assembly 12 with virtually no gap therebetween, whereby grip members 36 frictionally and compressively engage the radial edge of disc 15. Such compressive engagement permits one to grasp a new spike assembly with the wrench 25 before threading the pin 18 into the recess 16, thereby making installation a much easier task with the invention. The dimensional relationship between wrench head 26 and disc 15 is shown best in FIGS. 10 and 11.

Figure 10:
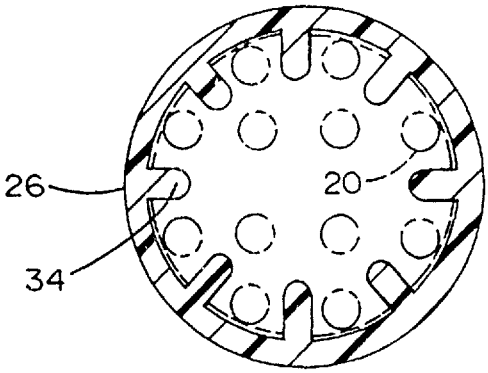
FIG. 10 is a head end view of the invention while the wrench engages a spike assembly.
Figure 11:
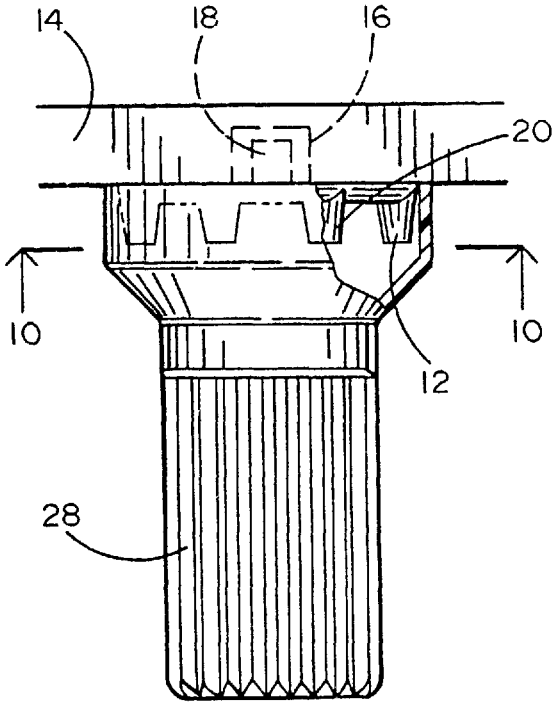
FIG. 11 is a partially cut-away side view of the engaged wrench and spike assembly of FIG. 10.

The number and spacing of torque members 34 is preferably related to the number and spacing of spikes 20 so that they are equal or at least similar to those shown in FIGS. 10 and 11 wherein each torque member engages a corresponding spike upon a few degrees of rotation of the wrench in either direction (i.e., clockwise or counterclockwise).

The handle 28, in the preferred embodiment, has a plurality of elongated ribs 29 which have a generally triangular cross-section to provide a slip-proof grip to the handle. The handle 28 also comprises an elongated central passage 30 which is preferably hexagonally-shaped to receive an Allen-type wrench insert for applying greater levels of torque for removing worn spike assemblies or for installing new spike assemblies. The passage 30 may also be shaped to mate with ratchet wrenches, electric drills and other devices which may be used to apply manual or powered torque to the wrench 25.

Having thus disclosed the present invention in the form of a preferred embodiment, it being understood that other embodiments are readily created while relying on the basic concepts hereof, what we claim as our invention is the following:

1. A wrench for removing and installing spike assemblies of the type used in sports shoes to provide increased footing on a penetrable surface such as grass; the wrench being configured for engagement with spike assemblies having a plurality of symmetrically spaced soft spikes extending from one surface of a substantially flat circular disc and having a threaded pin extending from an opposed surface of the disc for threaded mating with a recess in the sole of a shoe; the wrench comprising:

a wrench head having a recess for engaging said disc in gripping relation;

a handle extending integrally from said wrench head for applying torque thereto; and wherein said wrench head comprises a plurality of symmetrically spaced torque members for simultaneously engaging said soft spikes for rotation of said disc in response to a rotational force applied to said handle.

2. The wrench recited in claim 1 wherein said wrench head comprises a plurality of grip members for compressively engaging said disc.

3. The wrench recited in claim 1 wherein said handle comprises a recess shaped for receiving a tool for applying increased torque to said disc.

4. A wrench for removing and installing spike assemblies of the type used in sports shoes to provide increased footing on a penetrable surface such as grass; the wrench being configured for engagement with spike assemblies having a plurality of symmetrically spaced soft spikes extending from one surface of a substantially flat circular disc and having a threaded pin extending from an opposed surface of the disc for threaded mating with a recess in the sole of a shoe; the wrench comprising:

a wrench head having a recess for engaging said disc in gripping relation;

a handle extending integrally from said wrench head for applying torque thereto; and wherein said wrench head comprises a plurality of symmetrically spaced torque members for simultaneously engaging said soft spikes for rotation of said disc in response to a rotational force applied to said handle and a plurality of grip members for compressively engaging said disc.

5. A wrench for removing and installing spike assemblies of the type used in sports shoes to provide increased footing on a penetrable surface such as grass; the wrench being configured for engagement with spike assemblies having a plurality of symmetrically spaced soft spikes extending from one surface of a substantially flat circular disc and having a threaded pin extending from an opposed surface of the disc for threaded mating with a recess in the sole of a shoe; the wrench comprising:

a wrench head having a recess for engaging said disc in gripping relation;

a handle extending integrally from said wrench head for applying torque thereto; and wherein said wrench head comprises a plurality of symmetrically spaced torque members for simultaneously engaging said soft spikes for rotation of said disc in response to a rotational force applied to said handle and a plurality of grip members for compressively engaging said disc and wherein said handle comprises a recess shaped for receiving a tool for applying increased torque to said disc.

6. The wrench recited in claim 1 wherein said handle comprises a plurality of elongated surface ribs for providing increased frictional engagement with said handle.

* * * * *